US006296594B1

(12) United States Patent
Simonson

(10) Patent No.: US 6,296,594 B1
(45) Date of Patent: Oct. 2, 2001

(54) QUAD/HAMSTRING EXERCISE APPARATUS

(75) Inventor: Roy Simonson, Colorado Springs, CO (US)

(73) Assignee: The Simonson Family Limited Partnership RLLLP, Colorado Springs, CO (US)

( * ) Notice: Subject to any disclaimer, the term of this patent is extended or adjusted under 35 U.S.C. 154(b) by 0 days.

(21) Appl. No.: 09/437,318

(22) Filed: Nov. 10, 1999

(51) Int. Cl.[7] ..... A63B 23/04; A63B 21/06
(52) U.S. Cl. ..... 482/79; 482/102; 482/103
(58) Field of Search ..... 482/79, 99–103, 482/124, 129, 130, 134, 139

(56) References Cited

U.S. PATENT DOCUMENTS

| | | | | |
|---|---|---|---|---|
| 337,942 | | 3/1886 | Farley . | |
| 353,089 | * | 11/1886 | Smith . | |
| 457,400 | | 8/1891 | Dowd . | |
| 2,436,987 | * | 3/1948 | Bailleaux | 272/81 |
| 3,840,227 | | 10/1974 | Chesemore . | |
| 4,257,590 | * | 3/1981 | Sullivan et al. | 272/117 |
| 4,325,548 | | 4/1982 | Piccini . | |
| 4,515,363 | | 5/1985 | Scleffendorf . | |
| 4,635,926 | | 1/1987 | Minkow . | |
| 4,650,183 | | 3/1987 | McIntyre . | |
| 4,807,874 | | 2/1989 | Little . | |
| 4,898,381 | * | 2/1990 | Gordon | 272/117 |
| 5,158,518 | | 10/1992 | Pizzuto . | |
| 5,328,430 | | 7/1994 | Vittone et al. . | |
| 5,419,749 | | 5/1995 | Morgenstein . | |
| 5,518,476 | | 5/1996 | McLeon . | |
| 5,616,107 | | 4/1997 | Simonson . | |
| 5,738,616 | * | 4/1998 | Robertson | 482/102 |
| 5,749,668 | | 5/1998 | McIlvain et al. . | |
| 5,800,321 | | 9/1998 | Webber . | |
| 5,897,472 | | 4/1999 | Thulasingam . | |
| 5,931,767 | * | 8/1999 | Morales | 482/102 |

OTHER PUBLICATIONS

Tri–Pulley and High Lat Pulley, Free Standing Adapter Base, AMF American Strength and Conditioning catalog, pp. 12 and 13, 1981.*

Body Masters—Master Trainer I and II brochure, 1994.*

Body Masters—Super Multi–Trainer 8, broshure, 1994.*

Cybex—Cable Column, Modular brochure, Cybex Strength Systems, 1994.*

Deluxe Therapeutic Exercise Pulleys—Bilateral, Cardon Rehabilitation Products, Inc. catalog, p. 3, 1995.*

672—The Cable Crossover, Parrillo The Hardcore Advantage catalog, p. 31, 1995.*

Deluxe Wall Pulley System and Mobile Pulley System, Flaghouse Rehab Spring catalog, p. 20, 1995.*

* cited by examiner

*Primary Examiner*—Mickey Yu
*Assistant Examiner*—Victor Hwang
(74) *Attorney, Agent, or Firm*—Hoffman, Wasson & Gitler, PC

(57) ABSTRACT

An exercise apparatus is disclosed. The apparatus includes a base structure having a central support member secured to a vertically oriented resistance assembly with a resistance member. The apparatus further includes a cable linking the resistance member to a user interface coupled to an end of the cable. A first pulley is pivotally mounted adjacent a lower end of the resistance assembly. The cable passes over the first pulley to direct the cable toward the lower body of an individual using the exercise apparatus. The first pulley also includes a cylindrical member through which the cable passes such that the cable extends substantially along an it axis about which the first pulley pivots.

10 Claims, 4 Drawing Sheets

QUAD/HAMSTRING EXERCISE APPARATUS

BACKGROUND OF THE INVENTION

1. Field of the Invention

The invention relates to lower body exercise apparatuses. More particularly, the invention relates to hamstring and quadriceps exercise apparatuses providing added convenience and versatility.

2. Description of the Prior Art

As with most major muscle groups, a wide variety of exercise apparatuses have been developed to specifically exercise the quadriceps and hamstrings of a user. Prior art apparatuses are, however, limited in their ability to provide users with a convenient exercise routine allowing users the flexibility to vary their lines of motion.

A continuing need, therefore, exists for improved hamstring and quadriceps exercise apparatuses. Such apparatuses should be designed to make the exercise process simpler, safer and more flexible. The present invention provides such an exercise apparatus.

SUMMARY OF THE INVENTION

It is, therefore, an object of the present invention to provide an exercise apparatus including a base structure having a central support member secured to a vertically oriented resistance assembly with a resistance member. The apparatus further includes a cable linking the resistance member to a user interface coupled to an end of the cable. A first pulley is pivotally mounted adjacent a lower end of the resistance assembly. The cable passes over the first pulley to direct the cable toward the lower body of an individual using the exercise apparatus. The first pulley also includes a cylindrical member through which the cable passes such that the cable extends substantially along an axis about which the first pulley pivots.

It is also an object of the present invention to provide an exercise apparatus including a second pulley substantially identical to the first pulley described above.

It is another object of the present invention to provide an exercise apparatus wherein the cable exits the resistance assembly at a position above the first pulley and the second pulley.

It is a further object of the present invention to provide an exercise apparatus wherein the first pulley and the second pulley are mounted on opposite sides of the resistance assembly.

It is also another object of the present invention to provide an exercise apparatus wherein the cable is a single cable.

It is still another object of the present invention to provide an exercise apparatus wherein the resistance assembly is a weight stack.

It is yet a further object of the present invention to provide an exercise apparatus including a user support member.

It is also an object of the present invention to provide an exercise apparatus wherein the user support member is an upwardly extending support bar.

It is another object of the present invention to provide an exercise apparatus wherein the central support member includes a first end to which the user support member is attached and a second end to which the resistance assembly is attached.

It is a further object of the present invention to provide an exercise apparatus wherein the user support member is a handle coupled to the resistance assembly.

It is also an object of the present invention to provide an exercise apparatus wherein the axis about which the pulley pivots is substantially parallel to the longitudinal axis of the resistance assembly.

It is a further object of the present invention to provide an exercise apparatus including a base structure having a central support member with a first end to which a user support bar is secured and a second end to which a vertically oriented resistance assembly including a resistance member is secured. The user support bar extends upwardly to create a substantially U-shaped space in which an individual may freely move while exercising. A cable links the resistance member to a user interface coupled to an end of the cable. The apparatus also includes a first pulley pivotally mounted adjacent a lower end of the resistance assembly, wherein the cable passes over the first pulley to direct the cable toward the lower body of an individual using the exercise apparatus.

It is also an object of the present invention to provide an exercise apparatus wherein the user support bar is angularly oriented and extends away from the second end of the central support member.

It is another object of the present invention to provide an exercise apparatus wherein the user support bar includes a horizontally oriented grip.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
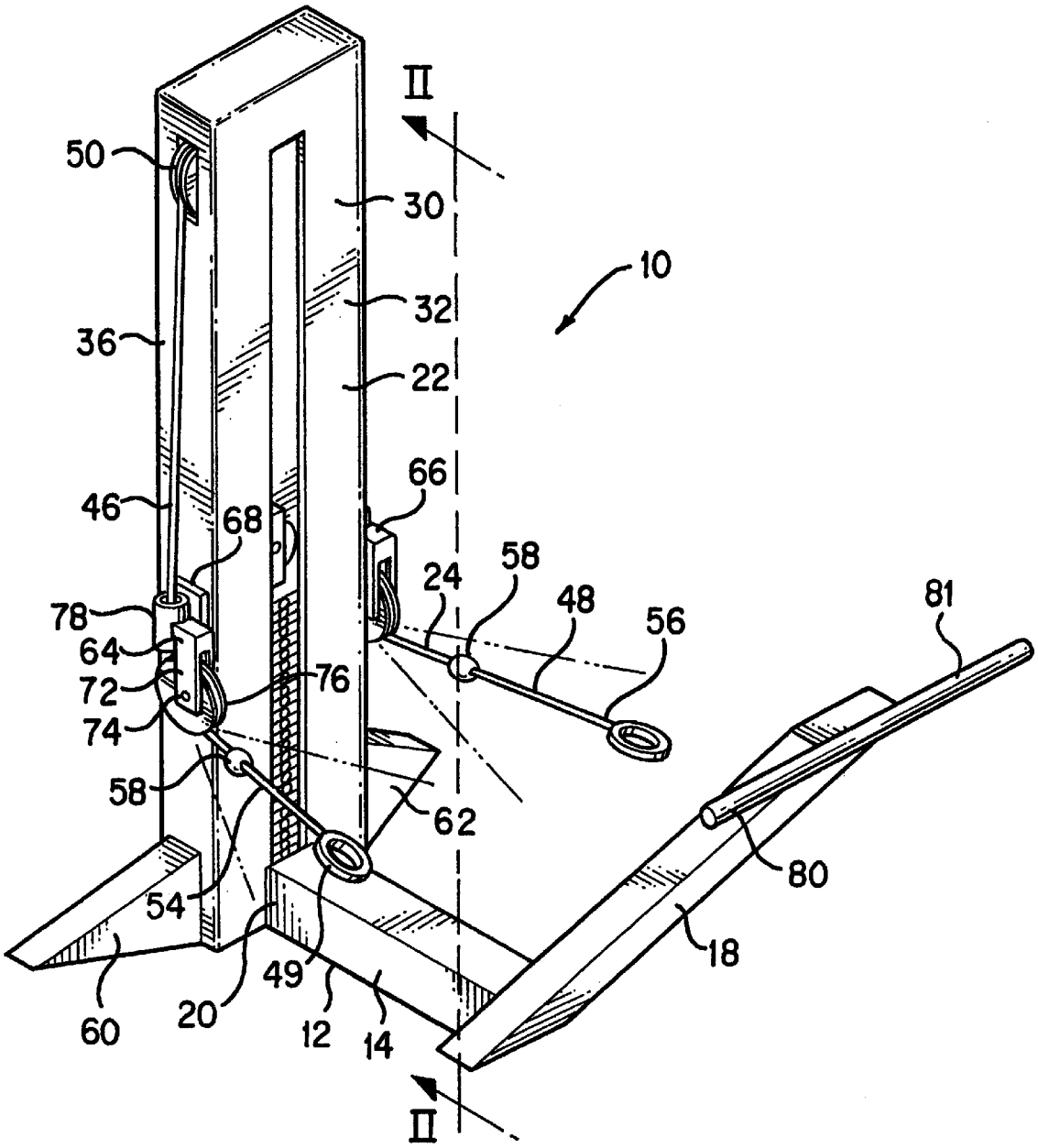
FIG. 1 is a perspective view of a quadriceps exercise apparatus in accordance with the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1 through 4, a quadriceps exercise apparatus 10 in accordance the present invention is disclosed. The quadriceps exercise apparatus 10 includes a base structure 12 having a central support member 14 with a first end 16 to which a user support structure 18 is secured and a second end 20 to which a resistance assembly, more particularly, a weight stack, 22 is secured. A single cable 24 actuates the weight plates 28 of the weight stack 22. The single cable 24 is secured to the weight stack 22 for movement by an individual using the quadriceps exercise apparatus 10.

The central support member 14 is preferably a tubular member with a rectangular cross section. As with all of the structural components used in the manufacture of the present quadriceps exercise apparatus 10, the central support member 14 is formed from steel, although those skilled in the art will appreciate the other materials which may be used in the construction of the disclosed exercise apparatus without departing from the spirit of the present invention.

The weight stack 22 is a conventional, vertically oriented weight stack. The weight stack 22 includes vertical support members 26 aligned to support a stack of weight plates 28 which are moved via the pulley system discussed below in greater detail. The weight stack 22 is covered by a protective sleeve 30 positioned about the weight stack 22. The weight stack 22 is vertically oriented and includes a front face 32, a rear face 34, a left side 36 and a right side 38.

As will be discussed below in greater detail, the weight stack 22 is actuated by a single cable 24 which controls the movement of the weight plates 28. The central portion 40 of the cable 24 is passed through a first pulley 42. A coupling member 44 directly couples the stack of weight plates 28 to the first pulley 42 in a conventional manner. Opposite strands 46, 48 of the cable 24 then respectively extend over first and second upper pulleys 50, 52 before exiting the weight stack 22 from the left and right sides 36, 38 thereof. The first and second strands 46, 48 are then directed downwardly and outwardly for engagement by the user.

The respective ends 54, 56 of the first and second strands 46, 48 are each provided with stop members 58. As those skilled in the art will readily appreciate, the stop members 58 control motion of the single cable 24 to allow exercise by pulling the first strand 46 alone, the second strand 48 alone, or both strands at the same time.

First and second lateral support members 60, 62 are also secured to the second end 20 of the central support member 14. The lateral support members 60, 62 extend outwardly from the longitudinal axis of the central support member 14 and away from the first end 16 of the central support member 14. The combination of the cental support member 14, the first lateral support 60 and the second lateral support 62 create a tripod foundation structure. This foundation structure supports the remaining components of the quadriceps exercise apparatus 10, as well as users of the present exercise apparatus.

As mention above, the first and second strands 46, 48 of the cable 24 exit the weight stack 22 after passing over the first and second upper pulleys 50, 52. After exiting the weight stack 22, the first and second strands 46, 48 move downwardly respectively along the left and right sides 36, 38 of the weight stack 22 until they pass through the first and second pivoting pulleys 64, 66 secured to the sides of the weight stack 22.

The first and second pivoting pulleys 64, 66 are respectively coupled to mounting plates 68, 70 on the left and right sides 36, 38 of the weight stack 22. The pivoting pulleys 64, 66 are mounted in such a manner that they are able to pivot about a vertical axis substantially parallel to the longitudinal axis of the weight stack 22. In this way, the strands 46, 48 of the cable 24 respectively exit the weight stack 22 along the left and right sides 36, 38 thereof, pass over the pivoting pulleys 64, 66 and are ready for engagement by the user. The distal ends of each strand 46, 48 of the cable 24 may be fitted with a wide variety of user interfaces 49 known to those skilled in the art. The user interfaces should be chosen from the group designed specifically for attachment to the lower legs and feet of exercisers. Such interfaces are well known in the art, and those skilled in the art will appreciate the many interfaces which may be used without departing from the spirit of the present invention.

Each pivoting pulley 64 (the first pivoting pulley will be described here in detail) includes a frame 72 with a central pivot 74 for rotatably supporting a pulley member 76. The frame 72 is formed so as to support the pulley member 76. The frame 72 further includes a cylindrical coupling member 78 shaped and dimensioned for pivotal attachment to the mounting plate 68. The coupling member 78 is secured to the mounting plate 68 such that the pivoting pulley 64 may freely pivot about the axis extending through the center of the cylindrical coupling member 78. The cylindrical coupling member 78 provides an opening through which the cable 24 passes as it extends downwardly from the upper pulleys 50, 52 toward the pulley member 76. In this way, the cable 24 passes along the axis about which the pivoting pulley 64 pivots to provide greater freedom of motion as an individual attempts to draw the cable in various directions during exercise.

Since the pivoting pulley 64 permits a great degree of flexibility with regard to the angle at which the cable 24 is drawn from weight stack 22, the inclusion of the present pivoting pulley 64, 66 at the sides of the weight stack 22 greatly increases the flexibility of the present exercise apparatus 10.

The first and second pivoting pulleys 64, 66 extend outwardly, and in opposite directions, from the lower end 82 of the weight stack 22 such that the first and second strands 46, 48 are directed to a position approximately in line with the legs of an individual utilizing the present quadriceps exercise apparatus. Given that the pivoting pulleys 64, 66 are secured adjacent the lower end of the weight stack 20, the pivoting pulleys 64, 66 will be slightly above the ground upon which the user stands. Specifically, the pivoting pulleys are preferably positioned at height of approximately 36 inches from the center of the pulley relative to the ground upon which the user stands, although the pivoting pulleys may be positioned at various heights without departing from the spirit of the present invention.

Based upon the orientation of an exerciser properly using the present quadriceps exercise apparatus, the user support structure 18 consists of a rearwardly angled, and upwardly extending, user support bar 80 positioned for gripping by the user. The bar 80 includes a horizontal grip 81 for user comfort and security.

The combination of the vertically oriented weight stack 22, the central support member 14 and the rearwardly angle user support bar 80 creates a convenient open space for exercising. Specifically, an individual enters the apparatus and is free to stand upright while exercising or bend forward while exercising. The individual is also free to swing his or her legs through a small or large arc without worrying that the frame of the apparatus will impede leg motion. Regardless of the individuals chosen exercise position, the narrow profile of the apparatus opens the range of leg motions individuals may add to his or her exercise routine.

Figure 3:
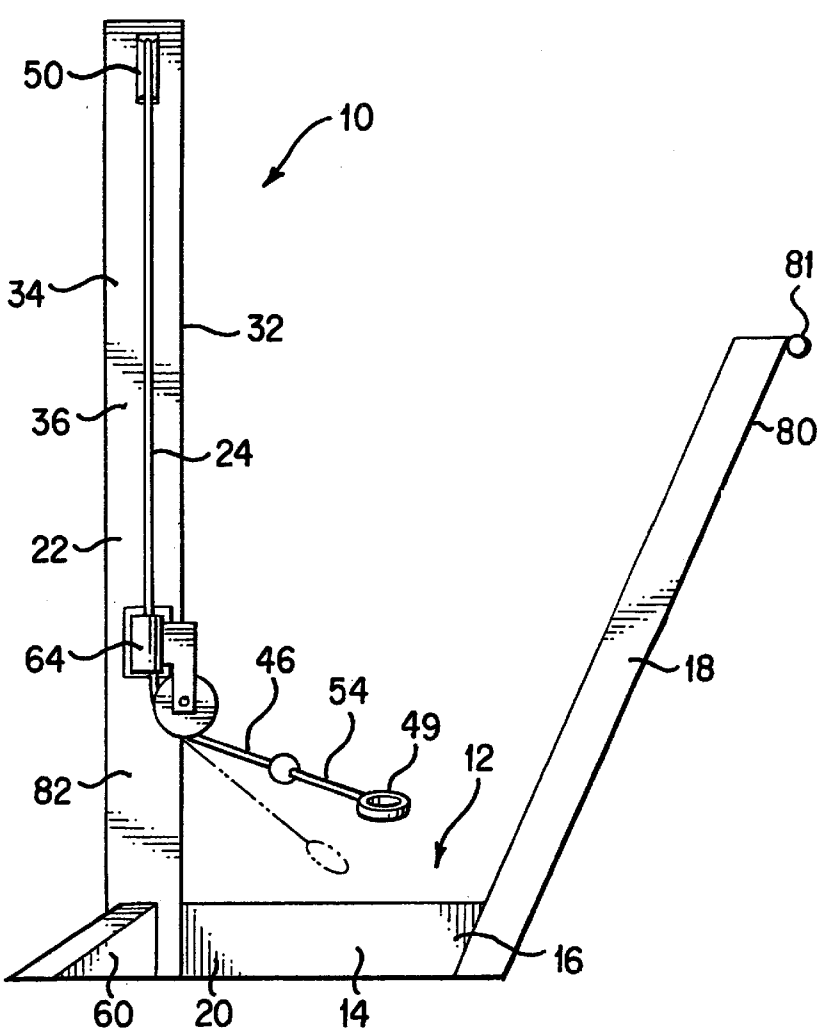
FIG. 3 is a side view of the quadriceps exercise apparatus shown in FIG. 1.
Figure 2:
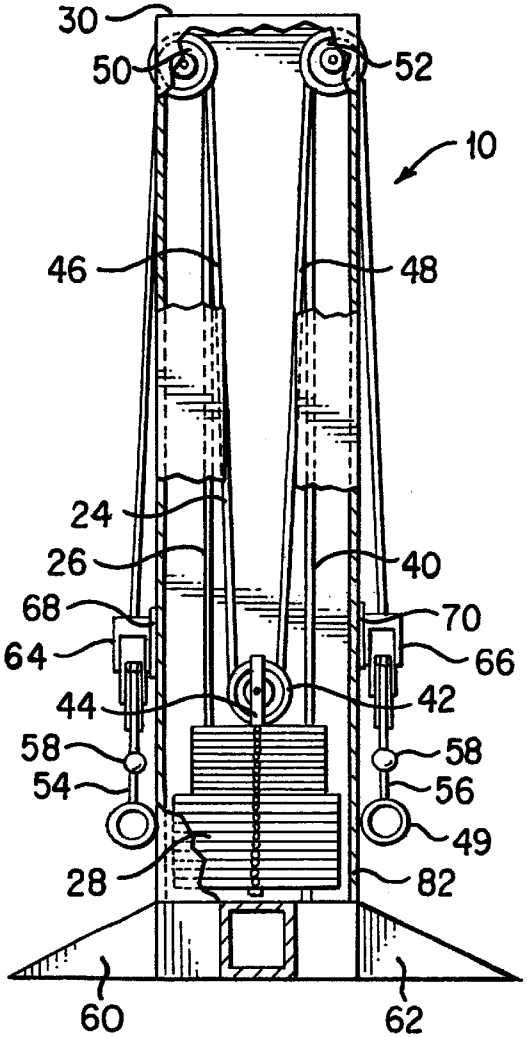
FIG. 2 is a cross sectional view of the quadriceps exercise apparatus along the line 2—2 in FIG. 3.
Figure 4:
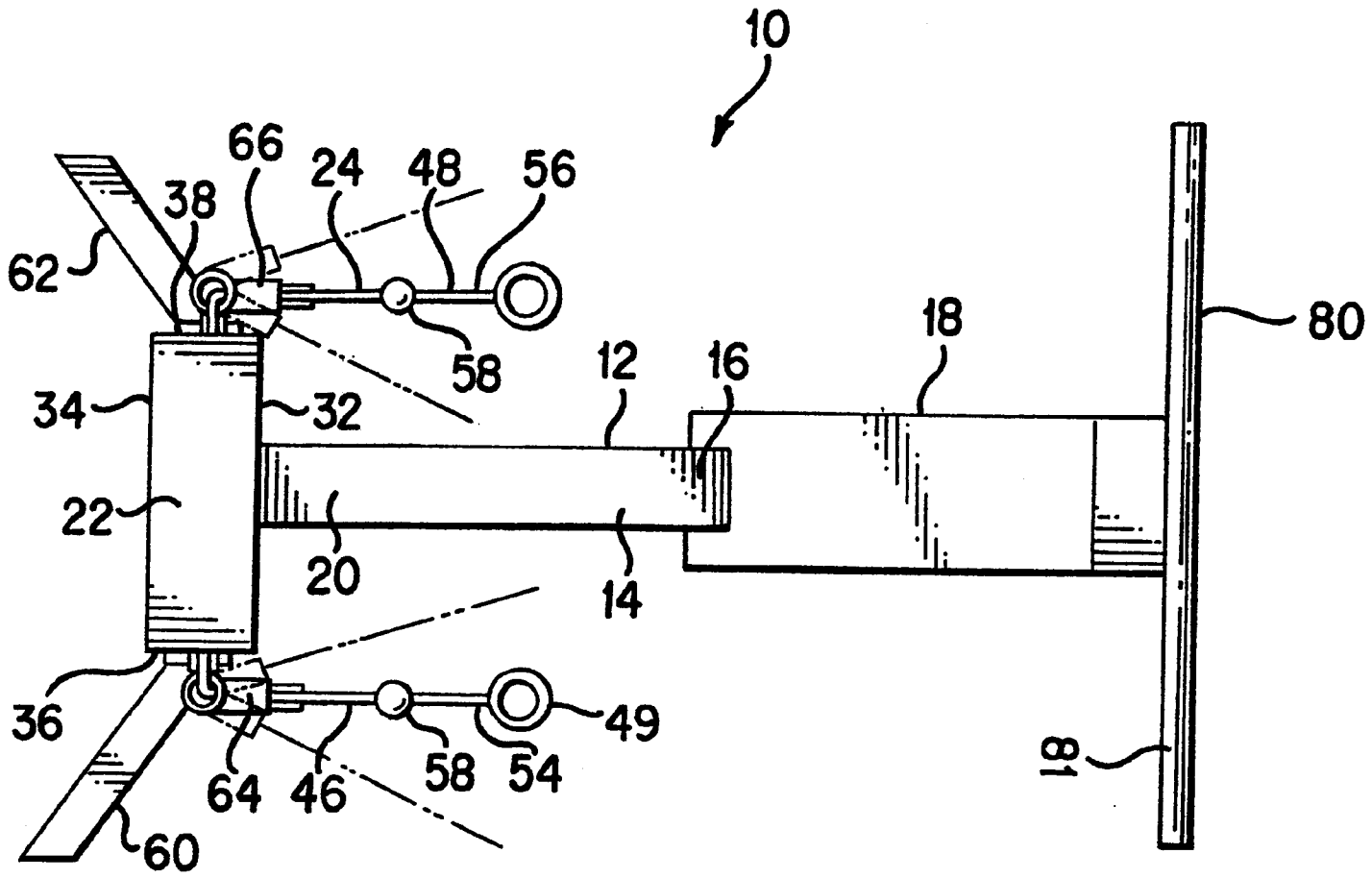
FIG. 4 is a top view of the quadriceps exercise apparatus shown in FIG. 1.

In use, the individual will be stand facing away from the weight stack 20. The individual will then secure the user interfaces 49 to his or her ankles or feet and grip the user support bar 80. The individual will then swing his or her legs away from the weight stack 22 to generate resistance from the weight stack 22. Movement of the individual's legs in this way acts to work the quadriceps of the individual. As shown in FIGS. 1, 3 and 4, the flexibility provided by the pivoting pulleys 64, 66 permits the individual to move in a wide variety of paths in order to equally exercise a wide variety of quadriceps muscles.

While it is disclosed above that the present quadriceps exercise apparatus is designed to be used with the user standing and facing away from the weight stack, the versatility provided by the design of the exercise apparatus provides users with virtually unlimited possibilities with regard to the range of exercise motions that may be accommodated by the present exercise apparatus.

Figure 6:
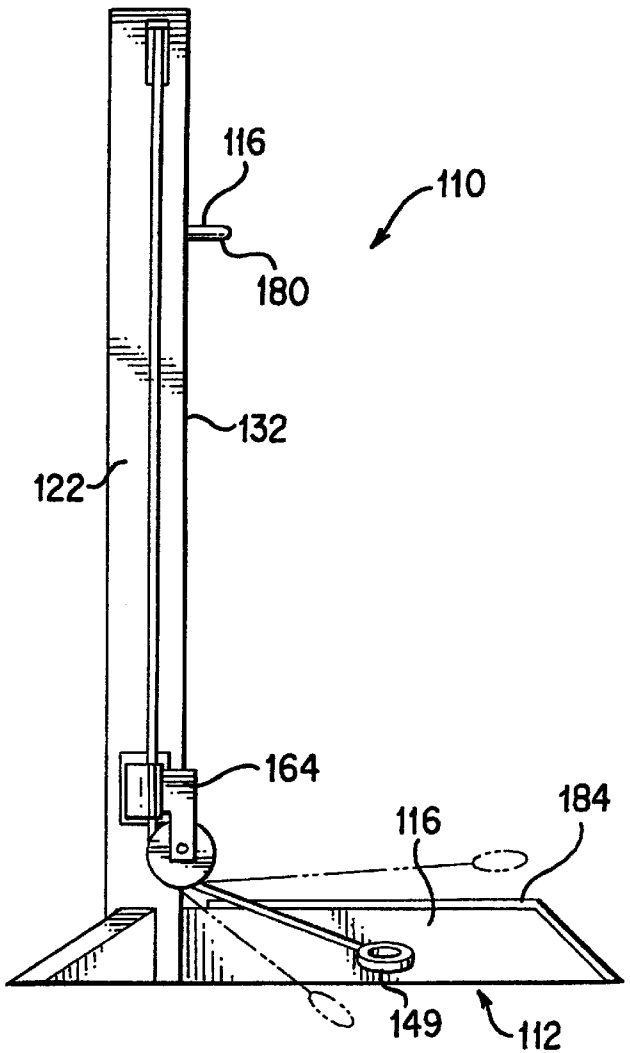
FIG. 6 is a side view of the hamstring exercise apparatus shown in FIG. 5.
Figure 5:
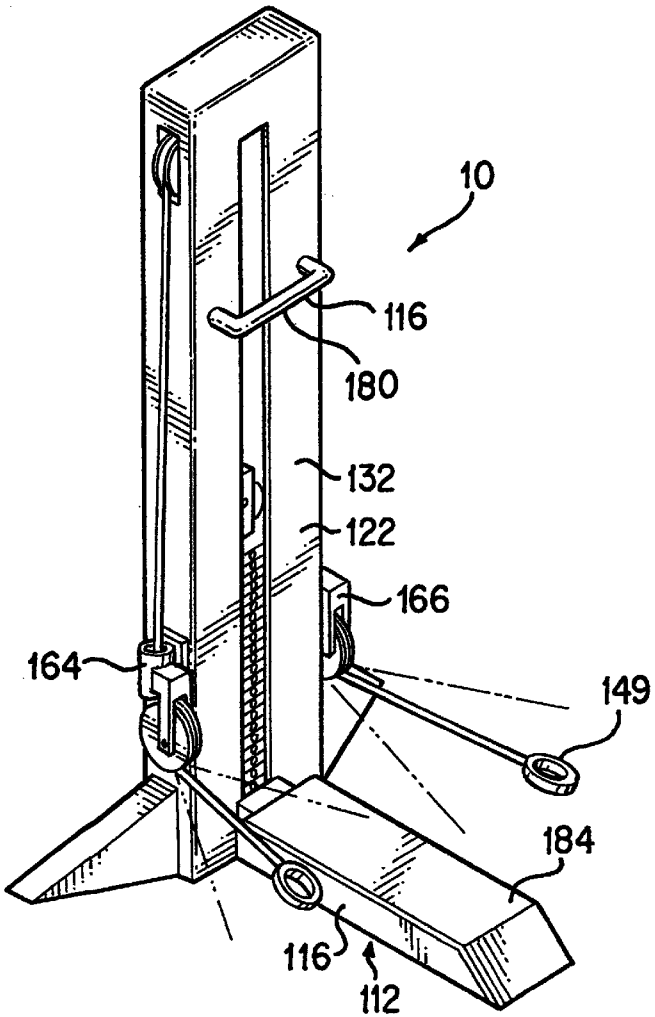
FIG. 5 is a perspective view of a hamstring exercise apparatus in accordance with the present invention.

With reference to FIGS. 5 and 6, a hamstring exercise apparatus 110 in accordance the present invention is disclosed. The hamstring exercise apparatus 110 is substantially similar to the quadriceps exercise apparatus 10 discussed above. As such, the hamstring exercise apparatus 110 includes the base structure 112 discussed above, as well as the cable arrangement discussed above.

Based upon the orientation of an exerciser properly using the present hamstring exercise apparatus 110, the user support structure 116 consists of a support handle 180 secured to the front face 132 of the weight stack 122. While a support handle 180 is disclosed in accordance with the present invention, other user support structures may be employed without departing from the spirit of the present invention.

In addition, the positioning of the pivoting pulleys 164, 166 varies slightly to accommodate the specific exercises being performed with the hamstring exercise apparatus 110. Specifically, the first and second pivoting pulleys 164, 166 are preferably positioned at height of approximately 10 inches from the center of the pulley relative to the ground upon which the user stands, although the pivoting pulleys 164, 166 may be positioned at various heights without departing from the spirit of the present invention.

Given the positioning of individuals using the present hamstring exercise apparatus 110, the central support member 116 may be provided with a user support platform 184 upon which an individual may stand while performing exercises.

In use, the individual will be stand facing the weight stack 122. The individual will then secure the user interfaces 149 to his or her ankles or feet and grip the user support handle 180. The individual will then swing his or her legs away from the weight stack 122 to generate resistance from the weight stack 122. Movement of the individual's legs in this way acts to work the hamstrings of the individual. As shown in FIGS. 5 and 6, the flexibility provided by the pivoting pulleys permits the individual to move in a wide variety of paths in order to equally exercise a wide variety of hamstring muscles.

While it is disclosed above that the present hamstring exercise apparatus is designed to be used with the user standing and facing away from the weight stack, the versatility provided by the design of the exercise apparatus provides users with virtually unlimited possibilities with regard to the range of exercise motions that may be accommodated by the present exercise apparatus.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. An exercise apparatus, comprising:

a base structure including a central support member secured to a vertically oriented resistance assembly including a resistance member;

a cable linking the resistance member to a user interface coupled to an end of the cable;

a first pulley pivotally mounted adjacent a lower end of the resistance assembly, wherein the cable passes over the first pulley to direct the cable toward the lower body of an individual using the exercise apparatus;

a user support member including an upwardly and rearwardly extending undifferentiated support bar having a horizontally oriented grip secured, the grip extending beyond opposite sides of the support bar for handling by an individual using the exercise apparatus and is positioned at a height permitting an individual to freely swing a leg thereunder; and wherein the central support member includes a first end to which the user support member is attached and a second end to which the resistance assembly is attached, and the user support member extends upwardly and rearwardly from the central support member with no portion of the central support member positioned therebeneath and no portion of the exercise apparatus beneath or rearward of the grip, creating a substantially U-shaped space in which an individual may freely move while exercising.

2. The exercise apparatus according to claim 1, further including a second pulley pivotally mounted adjacent the lower end of the resistance assembly, wherein a second strand of the cable passes over the second pulley to direct the cable toward the lower body of an individual using the exercise apparatus, the second pulley includes a cylindrical member through which the cable passes such that the cable extends substantially along an axis about which the second pulley pivots.

3. The exercise apparatus according to claim 2, wherein the cable exits the resistance assembly at a position above the first pulley and the second pulley.

4. The exercise apparatus according to claim 2, wherein the first pulley and the second pulley are mounted on opposite sides of the resistance assembly.

5. The exercise apparatus according to claim 2, wherein the cable is a single cable.

6. The exercise apparatus according to claim 5, wherein the resistance assembly is a weight stack.

7. The exercise apparatus according to claim 1, wherein the cable exits the resistance assembly at a position above the first pulley.

8. The exercise apparatus according to claim 1, wherein the pulley pivots about an axis which is substantially parallel to a longitudinal axis of the resistance assembly.

9. The exercise apparatus according to claim 1, wherein the first pulley includes a cylindrical member through which the cable passes such that the cable extends substantially along an axis about which the first pulley pivots.

10. The exercise apparatus according to claim 1 wherein the first pulley is positioned approximately 36 inches from the ground upon which the exercise apparatus sits.

* * * * *

UNITED STATES PATENT AND TRADEMARK OFFICE

CERTIFICATE OF CORRECTION

PATENT NO. : 6,296,594 B1
DATED : October 2, 2001
INVENTOR(S) : Roy Simonson

It is certified that error appears in the above-identified patent and that said Letters Patent is hereby corrected as shown below:

Title page,
Item [57], ABSTRACT,
Line 11, after "along an" delete "it"

Column 2,
Line 63, after "accordance" insert -- with --

Column 3,
Line 40, before "support" change "cental" to -- central --
Line 46, before "above," change "mention" to -- mentioned --

Column 4,
Line 59, before "stand" delete "be"

Column 5,
Line 11, after "accordance" insert -- with --
Line 39, before "stand" delete -- be --

Column 6,
Line 59, after "claim 1" insert a comma

Signed and Sealed this

Ninth Day of July, 2002

*Attest:*

JAMES E. ROGAN
*Director of the United States Patent and Trademark Office*

*Attesting Officer*